US006179419B1

(12) United States Patent
Rasmussen et al.

(10) Patent No.: US 6,179,419 B1
(45) Date of Patent: Jan. 30, 2001

(54) BELT DRIVEN MEDIA HANDLING SYSTEM WITH FEEDBACK CONTROL FOR IMPROVING MEDIA ADVANCE ACCURACY

(75) Inventors: Steve O Rasmussen; Richard A Kelley, both of Vancouver; Brooke E Smith, Brush Prairie, all of WA (US); Steven B. Elgee, Portland, OR (US)

(73) Assignee: Hewlett-Packard, Palo Alto, CA (US)

( * ) Notice: Under 35 U.S.C. 154(b), the term of this patent shall be extended for 0 days.

(21) Appl. No.: 09/163,098

(22) Filed: Sep. 29, 1998

(51) Int. Cl.[7] ..... B41J 2/01

(52) U.S. Cl. ..... 347/104; 400/582; 400/583.4

(58) Field of Search ..... 347/104; 400/582, 400/583.4, 635, 636.2; 271/4.05, 4.06, 7; 399/36, 164, 301, 394

(56) References Cited

U.S. PATENT DOCUMENTS

| | | | | |
|---|---|---|---|---|
| 4,147,339 | * | 4/1979 | Shiina | 271/7 |
| 4,207,579 | | 6/1980 | Gamblin et al. | 347/104 |
| 4,447,817 | | 5/1984 | Naramore | 347/104 |
| 4,660,752 | | 4/1987 | Rikard et al. | 226/95 |
| 4,682,904 | | 7/1987 | Yoshimura et al. | 400/616 |
| 4,821,049 | | 4/1989 | Eckl | 346/134 |
| 4,843,338 | | 6/1989 | Rasmussen et al. | 346/140 R |
| 5,080,666 | * | 1/1992 | Kupla et al. | 271/227 |
| 5,096,044 | * | 3/1992 | Biebel | 198/502.4 |
| 5,270,738 | * | 12/1993 | Takahashi et al. | 346/140 |
| 5,276,970 | | 1/1994 | Wilcox et al. | 33/18.1 |
| 5,342,133 | | 8/1994 | Canfield | 400/635 |
| 5,345,863 | | 9/1994 | Kurata et al. | 400/605 |
| 5,393,151 | | 2/1995 | Martin et al. | 400/642 |
| 5,419,644 | | 5/1995 | Martin et al. | 400/642 |
| 5,513,458 | * | 5/1996 | Dehli | 40/470 |
| 5,593,240 | | 1/1997 | Broder et al. | 400/352 |
| 5,802,422 | * | 9/1998 | Hokari | 399/36 |
| 5,873,315 | * | 2/1999 | Codos | 112/117 |
| 5,875,380 | * | 2/1999 | Iwata et al. | 399/301 |
| 5,950,051 | * | 9/1999 | Casella | 399/164 |
| 5,995,802 | * | 11/1999 | Mori et al. | 399/394 |

FOREIGN PATENT DOCUMENTS

| | | |
|---|---|---|
| 5112001 | 5/1993 | (EP) . |
| 0640479 | 3/1995 | (EP) . |
| 7304167 | 11/1995 | (EP) . |
| 6048385 | 3/1985 | (JP) . |

* cited by examiner

*Primary Examiner*—John S. Hilten
*Assistant Examiner*—Minh H. Chau

(57) ABSTRACT

A media handling system having an endless belt which carries a media sheet through a print zone achieves improved media advance accuracy by including closed loop feedback control. The position of either a drive shaft which rotates the endless belt or the endless belt itself is monitored to provide feedback to a drive motor. The drive motor is linked to the drive shaft through a gear train. The endless belt is rotated by the drive shaft, either directly, or through rollers mounted to the drive shaft.

25 Claims, 4 Drawing Sheets

FIG. 1
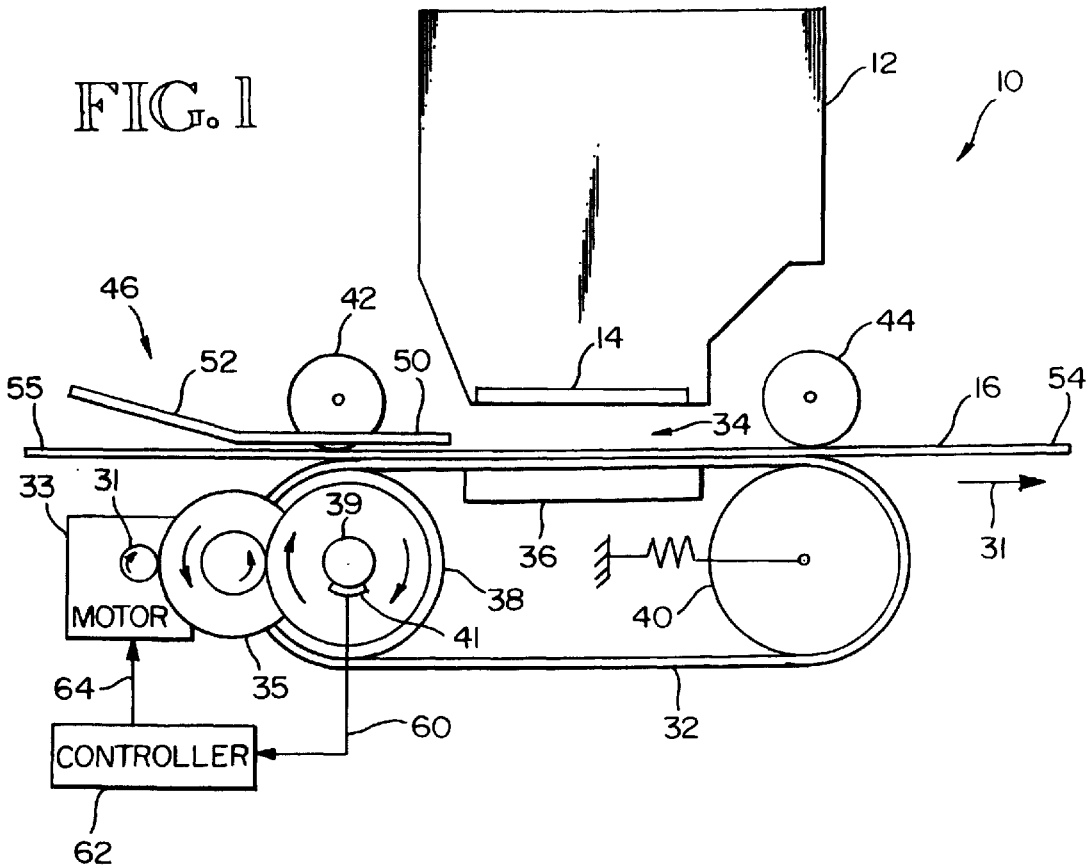
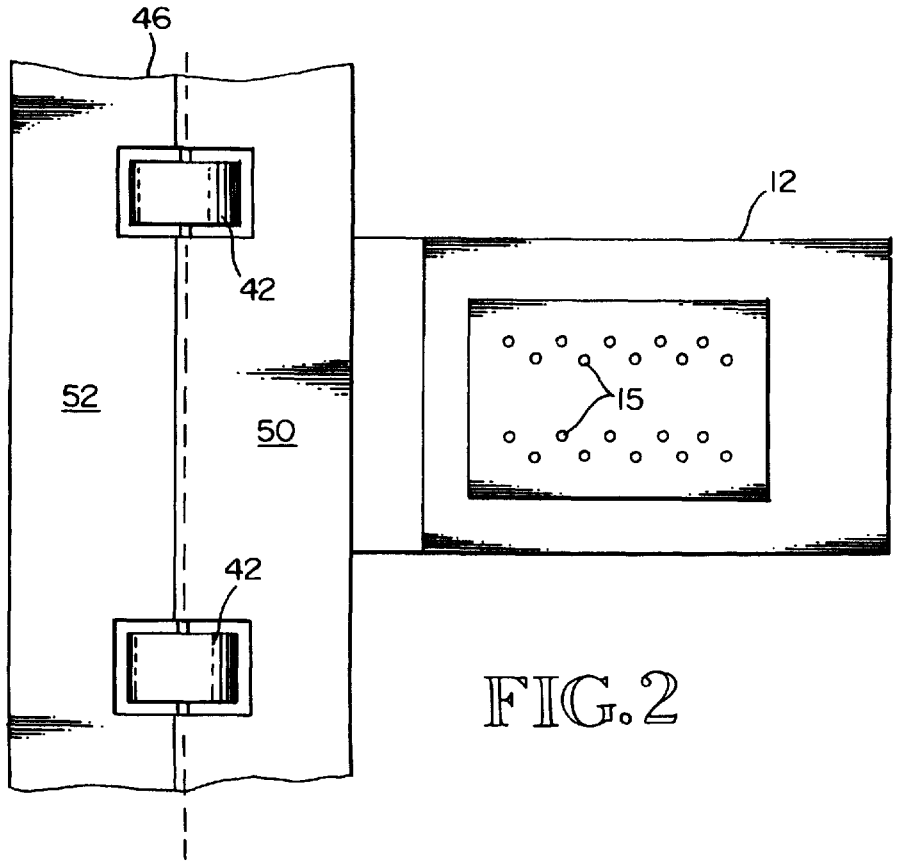
FIG. 2

FIG. 6
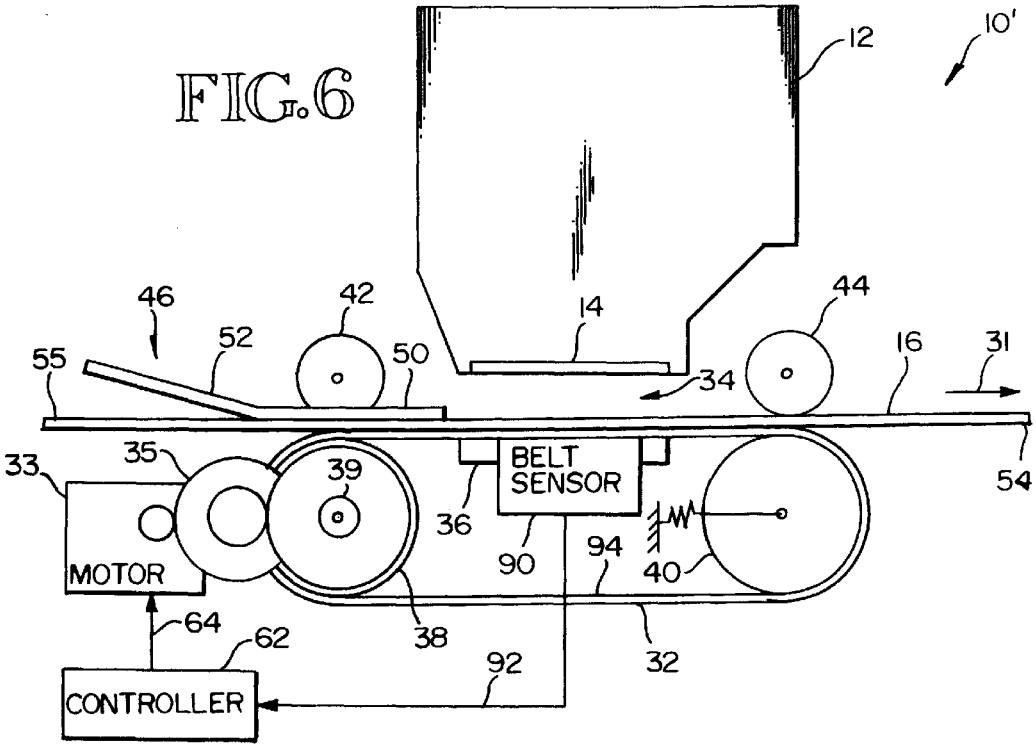
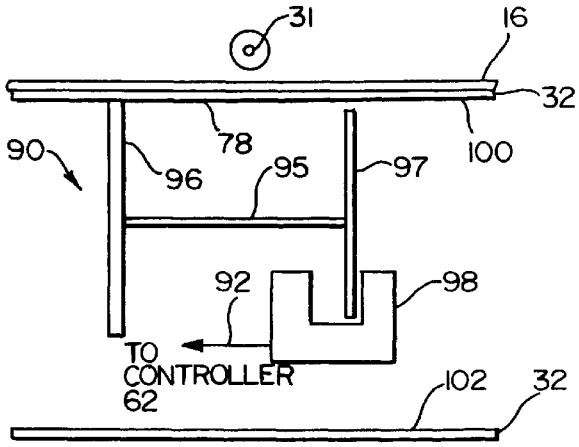
FIG. 7
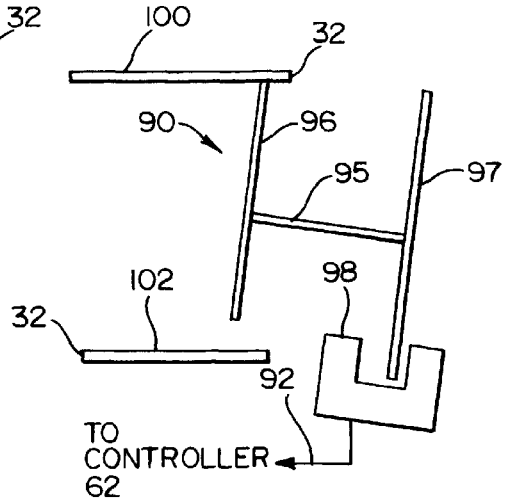
FIG. 9

BELT DRIVEN MEDIA HANDLING SYSTEM WITH FEEDBACK CONTROL FOR IMPROVING MEDIA ADVANCE ACCURACY

BACKGROUND OF THE INVENTION

This invention relates generally to media handling systems for inkjet printing devices, and more particularly to a media handling system which carries a media sheet along an endless loop belt.

Inkjet printing devices eject ink drops onto a media sheet from a plurality of nozzles. The ink drops form symbols, characters or graphics as desired. Placement of the drops is important for achieving desired print quality and resolution. To achieve accurate dot placement, the timing of each nozzle ejection is precisely controlled relative to the position of the media sheet. The media sheet is carried along a media path and passed through a print zone where ink drops are ejected onto the media sheet. To achieve accurate dot placement the motion of the media sheet is to be accurately controlled.

In conventional media handling systems, the media sheet is either stepped or continuously advanced. In a stepping embodiment, one or more rows of dots are printed at a time onto the media sheet while the media sheet is stationary. This occurs, for example, as an inkjet printhead is scanned across the media sheet. Alternatively, this occurs while a page wide array of inkjet nozzles ejects ink drops. Upon completion of printing to the one or more rows, the media sheet is advanced a known media advance distance. Another one or more rows of dots then are printed. For embodiments in which the media sheet is continuously advanced, the media sheet is moving while the inkjet printhead is scanning across the media sheet. For either approach, dot placement accuracy is affected by media advance accuracy.

This invention is directed toward a method and apparatus for improving media advance accuracy in a belt driven media handling subsystem for an inkjet printing apparatus.

SUMMARY OF THE INVENTION

According to the invention, a media handling system having an endless loop belt, which carries a media sheet through a print zone, achieves improved media advance accuracy by including closed loop feedback control. According to various embodiments, the position of either a drive shaft which rotates the endless belt or the position of the endless belt itself is monitored to provide feedback to a drive motor. The drive motor is linked to the drive shaft through a gear train. The endless belt is rotated by the drive shaft, either directly, or through rollers mounted to the drive shaft.

According to one aspect of the invention, feedback of the drive shaft is achieved by encoding the drive shaft or including a code wheel which turns with the drive shaft. The encoding is sensed and fed back to a controller as an indication of the angular position of the drive shaft. The controller uses the angular position to factor out motor errors or gear train errors. In a servo control loop the angular position serves as a servo error correction of the motor and gear train errors. By accurately controlling the drive shaft which rotates the belt, the belt position is accurately controlled.

To derive accurate media advance distance from the control of the drive shaft, the belt characteristics are measured, (e.g., average belt thickness). Profiles of expected wear of the belt over time also can be programmed into a calculation of media advance distance. Further, a profile of changes in belt thickness with changes in temperature also can be programmed into the calculation. Additional factors such as drive shaft runout or other shape characteristics also may be measured and used to achieve accurate media advance distance.

According to a preferred embodiment of the invention, the endless belt length is an integer multiple of the drive shaft diameter. Characteristics of the belt then may also be factored into the calculation to derive an accurate media advance distance. Exemplary belt factors include average belt thickness, thickness as a function of belt length, and how such factors change with age, wear or temperature.

According to an alternative embodiment where the belt length is not an integer multiple of the drive shaft circumference, the belt includes an indexed position which is related to an indexed or home position of the drive shaft. The index position of the belt is marked with a notch, an opening, a magnetic strip, a conductive strip, a bump or another feature which serves to distinguish the index position on the belt from other positions along the length of the belt.

According to an alternative aspect of the invention, rather than sense the drive shaft position, the belt position itself is sensed. The belt position serves as a feedback parameter for correcting motor error, gear train error, drive shaft error, and any other error occurring in the drive structures between the motor and the belt.

According to an aspect of the invention, the belt position is sensed by including a reflective encoder strip along the backside of the belt. An optical sensor then reads the encoder strip to monitor belt position. Alternatively, a sensor including CCD elements may be used, or a pick-up wheel and rotary encoder may be used. The belt position is detected from either the same side of the belt which carries the media sheet or the opposite side of the belt.

One advantage of the feedback control is that media advance accuracy is improved. A beneficial effect is that dot placement accuracy is improved and print quality is increased. These and other aspects and advantages of the invention will be better understood by reference to the following detailed description taken in conjunction with the accompanying drawings.

BRIEF DESCRIPTION OF THE DRAWINGS

FIG. 1 is a diagram of a portion of an inkjet printing apparatus according to an embodiment of this invention;

FIG. 2 is a diagram of the inkjet printhead and guide shim of FIG. 1;

FIG. 6 is a diagram of a portion of an inkjet printing apparatus according to another embodiment of this invention;

FIG. 7 is a diagrammatic view of a portion of the endless belt and sensor of FIG. 6;

FIG. 9 is a diagrammatic view of a portion of the endless belt and sensor of FIG. 6 according to another embodiment.

DESCRIPTION OF SPECIFIC EMBODIMENTS

Figure 3:
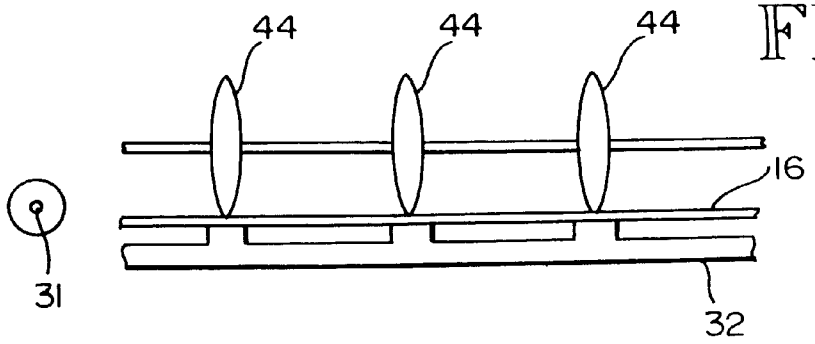
FIG. 3 is a cross sectional view of a portion of the belt and downstream star wheel pinch rollers of FIG. 1 according to one embodiment of this invention.

FIG. 1 shows an inkjet printing apparatus 10, according to an embodiment of this invention, for achieving improved media advance accuracy. The apparatus 10 includes an inkjet pen 12 having a printhead 14. The printhead 14 includes a plurality of inkjet nozzles 15 (see FIG. 2) which eject ink onto a media sheet 16 during printing. The media sheet 16 is moved along a media path in a direction 31 by one or more rollers. Over a portion of the media path, the media sheet 16 is carried by an endless loop belt 32. A print zone 34 occurs between the printhead 14 and the belt 32 in a region adjacent to the nozzles 15. The print zone 34 is the area where ink is ejected onto the media sheet 16. Within the print zone 34, a platen 36 maintains the belt 32 in a fixed orientation (e.g., so as to maintain a desired pen to media sheet spacing). As a result, the media sheet 16 is positioned at a known flat orientation within the print zone and ink is accurately applied to the media sheet 16.

The belt 32 runs along a drive roller 38 and an idler roller 40. One or more drive rollers 38 are mounted to a drive shaft 39. The drive shaft 39 is rotated by a drive motor 33 through a gear train 35 causing the belt 32 to move along the rollers 38, 40. The idler roller 40 preferably is spring-loaded to maintain the belt at a desired tension. Preferably, the belt 32 is stiff enough to prevent stretching over time. The belt 32 is reinforced with Kevlar in some embodiments to resist stretching. The spring-loading of idler roller 40 serves to maintain a desired belt tension even in the presence of some belt stretching. In one embodiment the belt is ribbed (see FIG. 3). The ribbing adds a measure of stability to the media sheet which helps reduce cockling of the media sheet 16. In another embodiment the belt has a grit coating 37, rather than ribs (see FIG. 4). For the belt embodiment having a grit coating, particles are dispersed within or on top of a coating. In an exemplary embodiment, a polyurethane coating is used with a grit of aluminum oxide particles having an average particle size of 0.0005 inches to 0.005 inches. One of ordinary skill in the art will appreciate that other coating and particle sizes also may be used. The inventive concepts also apply for a smooth belt.

Figure 4:
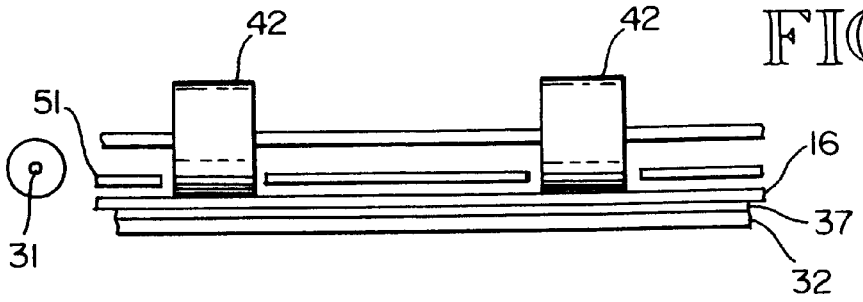
FIG. 4 is a cross sectional view of a portion of the belt, guide shim and upstream pinch rollers of FIG. 2 according to one embodiment of this invention.

The printing apparatus 10 also includes an upstream pinch roller 42, an optional downstream pinch roller 44, and a guide shim 46. The upstream pinch roller 42 presses the media sheet 16 to an outer surface 47 of the belt 32 in an area between the upstream pinch roller 42 and the drive roller 38 (see FIGS. 1 and 4). The downstream pinch roller 44, if present, presses the media sheet 16 to an outer surface 47 of the belt 32 in an area between the downstream pinch roller 44 and the idler roller 40. Preferably the downstream pinch roller 44 has a star wheel configuration which minimizes contact between the pinch roller 44 and the media sheet 16. This is desirable to avoid smudging the ink recently applied to the media sheet 16. The star wheel rollers 44 may be idle with individual mountings, or may be driven and have a common axle 70. For the ribbed belt, the ribbing extending along the direction of motion 31. The media sheet 16 moves under the star wheel rollers 44 along the ribs 72 of belt 32, as shown in FIG. 3.

The guide shim 46 includes a first portion 50 which extends from approximately the pinch roller 42 toward the print zone 34. Another portion 52 of the guide shim 46 extends from a position upstream from the upstream roller 42 toward the roller 42. The portion 50 has a first orientation relative to the media path. The portion 52 has a second orientation relative to the media path which differs from the first orientation. The guide shim portion 52 is angled relative to the travel of sheet 16 to direct an oncoming media sheet between the upstream pinch roller 42 and the drive roller 38 and onto the belt 32. The guide shim 46 serves to keep the media sheet 16 under the inkjet printhead 14 as the printhead 14 moves over the media sheet 16. This is desirable to prevent cockling or other distortions of the media sheet, in which the media sheet 16 bends upward into contact with the inkjet nozzles 15. Such contact can clog the inkjet nozzles 15 and cause inaccurate dot placement.

In one embodiment the guide shim portion 50 deflects the belt 32 and media sheet 16 to introduce a known reverse bow to the media sheet. In another embodiment, the guide shim portion 50 has a flat orientation relative to the media path through the print zone 34 as shown in FIG. 1). To reduce deterioration of the guide shim 50 by the grit coating of the belt 32, a portion of the guide shim may be coated, such as with an ultra-high molecular weight polyethylene film. The upstream pinch roller 42 presses the media sheet into the grit coating, which in effect adds a degree of friction and stability to the position of the media sheet 16 relative to the belt 32. Such stability continues while the media sheet's trailing edge 55 passes beyond the pinch roller 42 toward the print zone 34.

Feedback Control—Drive Shaft Feedback

Due to manufacturing tolerances, wear and vibrational effects, the drive system advancing the belt 32 may generate position errors. Such position errors may cause the media sheet 16 to be advanced by an erroneous length. The overall effect of such errors is that dot placement accuracy may be compromised. According to an aspect of this invention, feedback control is provided to factor out such errors. In the embodiment of FIG. 1, a feedback signal 60 indicative of the drive shaft 39 position is generated. More specifically, the angular position of the drive shaft 39 is sensed. In an exemplary embodiment a digital or analog encoder 41 is used to sense such angular position. The feedback signal 60 is fed into a controller 62. In one embodiment the controller 62 is part of the motor 33 and the feedback loop forms a servo control loop. A servo error then offsets the motor error, gear train 35 errors and drive shaft 39 error to enable the motor 33 to accurately advance the media sheet 16. In another embodiment the controller 62 is separate from the motor 33 and provides a control signal 64 to the motor to control the motor speed.

The errors factored out by the feedback loop include any motor errors (e.g., bearing error, motor shaft error), gear train 35 errors, and drive shaft 39 errors. Drive roller errors also may be factored in by identifying roller errors in advance and programming such errors into the controller transformation function. The transformation function is the transformation which generates the control signal 64 in response to the feedback signal 60. Shape deformities in the rollers 38, for example, are fixed relative to the drive shaft 39. Thus, the deformities can be related to the drive shaft position. The feedback signal 60 indicates drive shaft position, so a known shape deformity of the roller 38 can be looked up in a memory of the controller 62 and factored into the transformation function. Drive roller characteristics such as diameter, runout or other shape characteristics may be factored in, along with how these characteristics change with age, wear or temperature. In addition, some belt characteristics may be factored in, such as average belt thickness and how such thickness changes with age, wear and temperature.

In one embodiment the belt 32 length is an integer multiple of the drive roller 38 circumference. As a result, each point on the belt will line up with the same corresponding point of the roller for every rotation of the belt 32. Thus, errors in the belt 32 will also be fixed relative to the drive shaft 39 position. Rather than average belt thickness, a belt thickness as a function of belt position then can be factored into the transformation function of controller 62, along which changes over age, wear and temperature.

Figure 5:
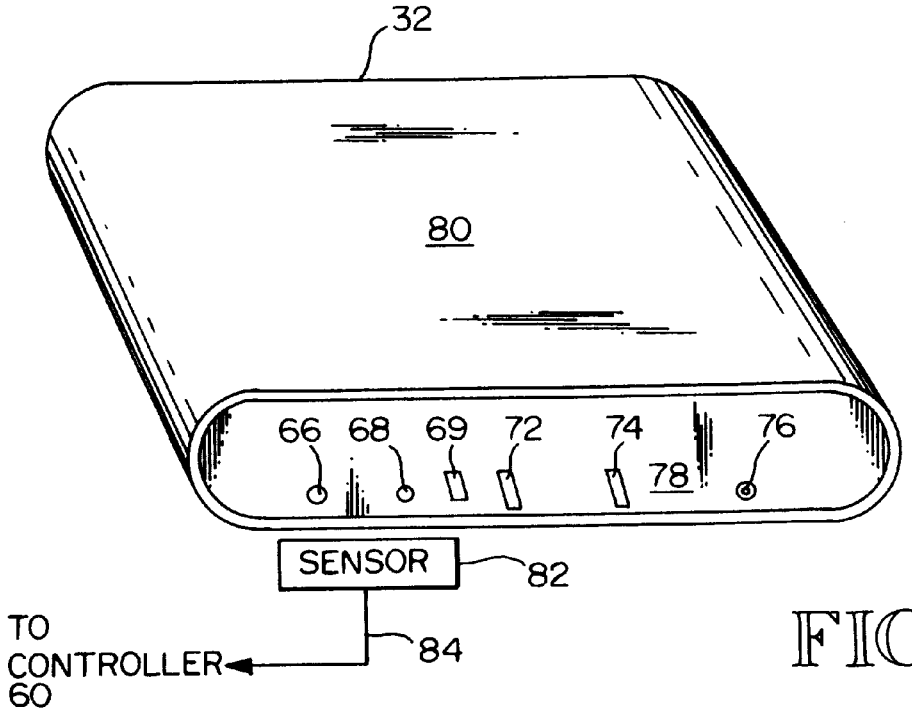
FIG. 5 is a perspective view of the endless belt of FIG. 1.

In another embodiment the belt 32 length is not an integer multiple of the drive roller 38 circumference. To factor in belt characteristics which vary with the position along the length of the belt 32, the belt position is indexed relative to the drive roller 38/drive shaft 39 position. Referring to FIG. 5, in such embodiment the belt 32 includes an indexing marking, such as a hole 66, a notch 68, a reflector 69, a magnetic strip 72, a conductive strip 74 or a bump 76 along the belt 32 inner surface 78 or outer surface 80. Although the alternative marking types are illustrated, preferably there is only one or more index marking of the same type. For embodiments having one index marking, the index marking corresponds to a home or a reference position along the length of the belt 32.

A sensor 82 (see FIG. 5) detects the index marking on the belt as the marking passes the sensor. Preferably the sensor 82 is fixed relative to the media handling system and the belt 32 moves relative to the fixed sensor 82. In response to a detection of the index marking the sensor 82 generates an indexing signal 84 which is output to the controller 60. The controller 60 uses the indexing signal 84 to synchronize access to a table of belt characteristic data which varies as a function of the positional length of the belt 32. The accessed belt characteristic data is used in the transformation function to determine the control signal 64, and thus, the media advance distance. The sensor 82 is an optical sensor for a hole 66, notch 68 or reflector 60 embodiment of the index marking. The sensor 82 is a hall effect sensor for a magnetic strip 72 embodiment of the index marking. The sensor 82 is a capacitance, resistance or eddy current detector for a conductive strip 74 embodiment of the index marking. The sensor 82 is a mechanical sensor or an optical sensor with a tripped mechanical flag for the bump 76 embodiment of the index marking.

Feedback Control—Belt Feedback

Referring to FIG. 6, an alternative embodiment of feedback control is achieved by sensing belt 32 position, rather than drive shaft 39 position. The system 10' is the same as the system 10 of FIG. 1, but includes a belt sensor 90 which generates a feedback signal 92 to the controller 62. The drive shaft 39 may or may not be encoded. Like parts which perform the same function are given the same part numbers as in the FIG. 1 embodiment. By sensing the belt position directly, the belt position need not be derived as a function of the drive shaft position. Thus, drive shaft errors and drive roller errors are directly factored out—simplifying the transformation function. In one embodiment the belt sensor 90 is positioned adjacent the inner surface 78 of the belt 32 under the print swath path. In one embodiment the belt 32 includes a reflective encoder strip 94 that extends the length of the belt inner surface circumference. In such embodiment the sensor 90 is a reflective sensor which tracks markings on the strip 94 to identify the belt portion in the print swath. One of ordinary skill in the art will appreciate that the sensor 90 alternatively can be located away from the print swath path.

In another embodiment a charge-coupled device (CCD) embodies the sensor 90. The CCD reads a pattern on the backside of the belt. The inherent accuracy in the CCD array allows for accurate sensing of the belt position. Referring to FIG. 7, in still another embodiment a pick-up wheel 96, code wheel 97 and encoder 98 serve as the belt position sensor 90. The pick-up wheel 96 engages the inner surface 78 of the belt 32 to form a frictional contact with the belt. The contact exerts enough friction that the movement of the belt 32 in the direction 31 rotates the pick-up wheel 96 without slippage and without deforming the belt. In one embodiment the pick-up wheel 96 includes teeth for engaging the belt 32. The pick-up wheel 96 is on a shaft 95 which couples the pick-up wheel 96 to the encoder wheel 97. As the pick-up wheel 96 rotates, the encoder wheel 97 also rotates. The encoder wheel 97 includes precise markings. The encoder wheel 97 rotates with a portion of the encoder wheel 97 passing into the sensing path of an encoder 98 which senses the encoder wheel markings. The encoder 98 generates the feedback signal 92 to the controller 62. For greater accuracy, the diameter, runout and frictional characteristics of the pick-up wheel 96 are carefully controlled during design and manufacturing. In some embodiments the sensor 90 is implemented to sense the belt 32 at the outer surface 80 rather than the inner surface 78.

Figure 8:
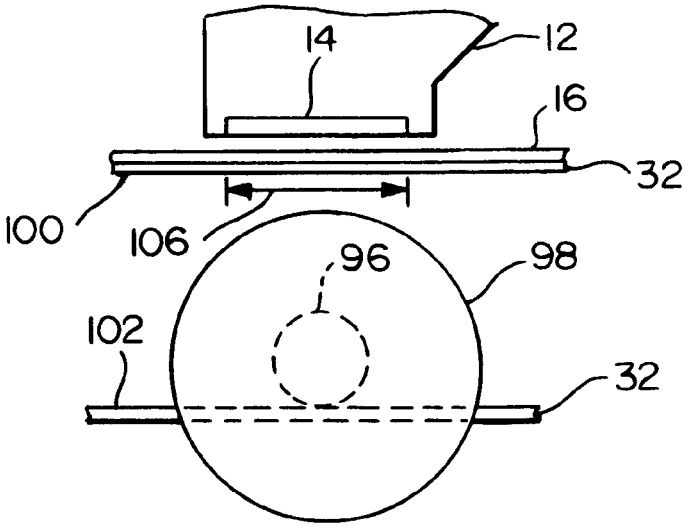
FIG. 8 is a diagrammatic view of a portion of the endless belt, inkjet pen, and sensor of FIG. 6 according to another embodiment of this invention.

Although it is preferable that the belt sensor 90 measure belt position by sensing a belt portion in the print swath path (the path the pen 12 scans along the width of the belt 32), the sensor 90 alternatively may be located elsewhere, as for example, shown in FIG. 8. To locate the sensor 90 elsewhere it is preferable that the belt 32 be generally rigid and have uniform thickness. For example, a sufficiently rigid belt will have the same motion at either the upper portion 100 or the lower portion 102 of the belt 32 (see FIGS. 7 and 8). One advantage of locating a pick-up wheel 96 of a sensor 90 along the lower portion 102 in alignment with the print swath is that the code wheel 97 will have room to be significantly larger than the pick-up wheel 96. This yields additional accuracy to the sensor 90 because the rotational variation in the pick-up wheel 96 is more easily detected by the larger diameter encoder wheel 97. The pick-up wheel 96 of FIG. 8 is located along the lower portion 102 of the belt 32 into contact with a portion of the belt either in or out of alignment with the print swath 106 above adjacent the upper portion 100. In addition or alternatively, the shaft 95 coupling the pick-up wheel 96 and encoder wheel 97 may be angled to prevent the encoder wheel from extending to the upper portion 100 of belt 32, as shown in FIG. 9. Alternatively, the pick-up wheel 96 is in contact with the upper portion 100 of the belt 32 and may be angled to prevent the encoder wheel 96 from extending into contact with the lower portion 102 of the belt 32.

Operation

In operation the drive motor 33 rotates a drive motor shaft 31 which engages the gear train 35. The gear train 35 links the drive motion to the drive shaft 39, and thus to the drive rollers 38. The drive rollers 38 rotate the endless loop belt 32 along a closed path defined by the drive rollers 38 and idler rollers 40. As a media sheet 16 is fed, a lead edge 54 of the media sheet 16 is guided by the shim 46, the upstream pinch roller 42 and drive roller 38 onto the belt 32. The belt 32 carries the media sheet 16 as the drive roller 38 moves the belt 32 and as the upstream pinch roller 42 presses a passing portion of the media sheet 16 toward the drive roller 38. The belt 32 passes along the platen 36 carrying a portion of the media sheet 16 into the print zone 34. The printhead nozzles 15 eject ink onto the portion of the media sheet 16 within the print zone 34. The printed portion of the media sheet 16 is carried onward from the print zone 34 along belt 32 to the downstream pinch roller 44. The downstream pinch roller 44 presses the media sheet toward the idler roller 40. During the printing and media handling process, the belt position is sensed by the belt sensor 90 (see FIG. 6) or the drive shaft 39 position is sensed by the drive shaft encoder 41 (see FIG.

1). The sensed position is fed back to the controller 62 which in response generates a control signal 64 to the drive motor 33 to control the media advance motion. The transformation function accounts for motor error, gear train error, drive shaft error, and in some embodiments drive roller characteristics and belt characteristics to achieve a desirably accurate control signal 64.

Typically, a media sheet 16 is longer than the distance from the upstream pinch roller 42 to the downstream pinch roller 44 along the media path. As a result, at least one of the upstream pinch roller 42 and downstream pinch roller 44 is in contact with the media sheet 16 while ink is being ejected onto any portion of the media sheet 16. The pinch rollers 42, 44 introduce a measure of stability to the media sheet during printing. The guide shim 46 aids in media advance accuracy as the media sheet trailing edge 55 departs contact with the upstream pinch roller 42 and continues on to the print zone 34. Specifically portion 50 of the guide shim 46 extends from the upstream pinch roller 42 toward the print zone 34, The shim together with the star wheel contact of the downstream pinch roller 44 stabilizes the media sheet 16 as the trailing edge 55 moves toward the print zone 34. The feedback control adds a further degree of media advance accuracy to the media handling function.

Meritorious and Advantageous Effects

One advantage of the feedback control is that media advance accuracy is improved. A beneficial effect is that dot placement accuracy is improved and print quality is increased.

Although a preferred embodiment of the invention has been illustrated and described, various alternatives, modifications and equivalents may be used. Therefore, the foregoing description should not be taken as limiting the scope of the inventions which are defined by the appended claims.

What is claimed is:

1. An inkjet printing apparatus which moves a media sheet along a media path and marks the media sheet with ink, comprising:

an inkjet printhead having a plurality of inkjet nozzles which eject ink onto a portion of the media sheet located within a print zone, the print zone located adjacent to the plurality of nozzles;

a endless loop belt having an outer surface upon which the media sheet rests as the media sheet passes along the media path through the print zone;

a drive shaft coupled to the belt which moves the belt in a closed loop;

a motor coupled to the drive shaft which spins the drive shaft to move the belt;

a sensor which detects drive shaft position, and in response generates a feedback signal which is coupled to the motor to correct for position errors and to provide accurate closed loop control of media advance along the belt; and a controller which receives the feedback signal and in response generates a control signal input to the motor, wherein the control signal is derived from at least the feedback signal and a belt characteristic.

2. The apparatus of claim 1, in which the belt has a length which is an integer multiple of the drive shaft circumference.

3. The apparatus of claim 2, in which the drive shaft comprises an elongated rod and a roller, and wherein the drive shaft circumference is a circumference of the roller.

4. The apparatus of claim 1, in which the belt has a feature along a length of the belt which identifies a reference position along the length of the belt.

5. The apparatus of claim 4, in which the drive shaft has a home position; and further comprising means for detecting alignment of the reference position of the belt with the home position of the drive shaft.

6. The apparatus of claim 1, wherein the control signal is derived from at least the feedback signal and a belt characteristic comprising average belt thickness.

7. The apparatus of claim 1, wherein the control signal is derived from at least the feedback signal and a belt characteristic comprising expected wear of the belt.

8. The apparatus of claim 1, wherein the control signal is derived from at least the feedback signal and a belt characteristic comprising changes in belt thickness relative to changes in temperature.

9. The apparatus of claim 1, wherein the control signal is derived from at least the feedback signal, a runout value for the drive shaft and a belt characteristic.

10. An inkjet printing apparatus which moves a media sheet along a media path and marks the media sheet with ink, comprising:

an inkjet printhead having a plurality of inkjet nozzles which eject ink onto a portion of the media sheet located within a print zone, the print zone located adjacent to the plurality of nozzles;

a endless loop belt having an outer surface upon which the media sheet rests as the media sheet passes along the media path through the print zone, in which the belt has a feature along a length of the belt which identifies a reference position along the length of the belt;

a drive shaft coupled to the belt which moves the belt in a closed loop, in which the drive shaft has a home position;

a motor coupled to the drive shaft which spins the drive shaft to move the belt;

a sensor which detects drive shaft position, and in response generates a feedback signal which is coupled to the motor to correct for position errors and to provide accurate closed loop control of media advance along the belt;

means for detecting alignment of the reference position of the belt with the home position of the drive shaft, wherein the detecting means generates a first signal indicative of said alignment of the reference position with the home position; and a controller which stores belt characteristics and receives the first signal and feedback signal, and in response generates a control signal output to the motor wherein the control signal is derived from the feedback signal and a belt characteristic, wherein the belt characteristic used to derive the control signal is accessed based at least in part on the first signal.

11. An inkjet printing apparatus which moves a media sheet along a media path and marks the media sheet with ink, comprising:

an inkjet printhead having a plurality of inkjet nozzles which eject ink onto a portion of the media sheet located within a print zone, the print zone located adjacent to the plurality of nozzles;

a endless loop belt having an outer surface upon which the media sheet rests as the media sheet passes along the media path through the print zone;

a drive shaft coupled to the belt which moves the belt in a closed loop;

a motor coupled to the drive shaft which spins the drive shaft to move the belt;

a sensor which detects belt position, and in response generates a feedback signal which is coupled to the motor to correct position errors and provide accurate closed loop control of media advance along the belt; and a controller which receives the feedback signal and in response generates a control signal input to the motor, wherein the control signal is derived from at least the feedback signal and a belt characteristic.

12. The apparatus of claim 11, wherein the control signal is derived from at least the feedback signal and a belt characteristic comprising average belt thickness.

13. The apparatus of claim 11, wherein the control signal is derived from at least the feedback signal and a belt characteristic comprising expected wear of the belt.

14. The apparatus of claim 1, wherein the control signal is derived from at least the feedback signal and a belt characteristic comprising changes in belt thickness relative to changes in temperature.

15. A method for controlling media advance along a belt through a print zone of an inkjet printing apparatus having a drive shaft driven by a drive motor, the drive shaft moving the belt, the belt being an endless loop belt, the printing apparatus including a printhead having a plurality of inkjet nozzles and a controller which stores data corresponding to belt characteristics, in which the belt has a feature along a length of the belt which identifies a reference position along the length of the belt, in which the drive shaft has a home position, the method comprising the steps of:

moving a media sheet along the endless loop belt through the print zone;

ejecting ink onto a portion of the media sheet within the print zone;

sensing drive shaft position;

adjusting media advance in response to the sensed drive shaft position;

and detecting alignment of the reference position of the belt with the home position of the drive shaft, and wherein the step of adjusting comprises adjusting media advance in response to the sensed drive shaft position and a belt characteristic accessed from the controller as a function of the detected alignment.

16. The method of claim 15, in which the belt has a feature along a length of the belt which identifies a reference position along the length of the belt.

17. The method of claim 16, in which the drive shaft has a home position; and further comprising the step of detecting alignment of the reference position of the belt with the home position of the drive shaft; and wherein the step of adjusting comprises adjusting media advance in response to the sensed drive shaft position and the detected alignment.

18. The method of claim 15, in which the step of adjusting comprises adjusting media advance in response to the sensed drive shaft and the accessed belt characteristic, said accessed belt characteristic comprising average belt thickness.

19. The method of claim 15, in which the step of adjusting comprises adjusting media advance in response to the sensed drive shaft and the accessed belt characteristic, said accessed belt characteristic comprising expected wear of the belt.

20. The method of claim 15, in which the step of adjusting comprises adjusting media advance in response to the sensed drive shaft and the accessed belt characteristic, said accessed belt characteristic comprising changes in belt thickness relative to changes in temperature.

21. The method of claim 15, in which the step of adjusting comprises adjusting media advance in response to the sensed drive shaft, runout of the drive shaft and the accessed belt characteristic.

22. A method for controlling media advance along a belt through a print zone of an inkjet printing apparatus having a drive shaft driven by a drive motor, the drive shaft moving the belt, the belt being an endless loop belt, the printing apparatus including a printhead having a plurality of inkjet nozzles and a controller which stores data corresponding to belt characteristics, the method comprising the steps of:

moving a media sheet along the endless loop belt through the print zone;

ejecting ink onto a portion of the media sheet within the print zone;

sensing belt position; and adjusting media advance in response to the sensed belt position and a belt characteristic accessed from the controller as a function of the sensed belt position.

23. The method of claim 22, in which the step of adjusting comprises adjusting media advance in response to the sensed drive shaft and the accessed belt characteristic, said accessed belt characteristic comprising average belt thickness.

24. The method of claim 22, in which the step of adjusting comprises adjusting media advance in response to the sensed drive shaft and the accessed belt characteristic, said accessed belt characteristic comprising expected wear of the belt.

25. The method of claim 22, in which the step of adjusting comprises adjusting media advance in response to the sensed drive shaft and the accessed belt characteristic, said accessed belt characteristic comprising changes in belt thickness relative to changes in temperature.

* * * * *